US011273565B2

(12) United States Patent
Good et al.

(10) Patent No.: US 11,273,565 B2
(45) Date of Patent: Mar. 15, 2022

(54) GROOMING DEVICE WITH EJECT BUTTON DISPLACEMENT

(71) Applicant: The Gillette Company LLC, Boston, MA (US)

(72) Inventors: Ian Anthony Good, Reading (GB); Balasundram Periasamy Amavasai, Reading (GB); Faiz Feisal Sherman, Mason, OH (US); Werner Friedrich Johann Bonifer, Eschborn (DE); Robert Thomas Hinkle, Sharonville, OH (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/920,300

(22) Filed: Jul. 2, 2020

(65) Prior Publication Data

US 2022/0001558 A1 Jan. 6, 2022

(51) Int. Cl.

| | |
|---|---|
| ***B26B 21/40*** | (2006.01) |
| ***B26B 21/52*** | (2006.01) |
| *B26B 21/22* | (2006.01) |

(52) U.S. Cl.

CPC ..... *B26B 21/4056* (2013.01); *B26B 21/4087* (2013.01); *B26B 21/521* (2013.01); *B26B 21/526* (2013.01); *B26B 21/225* (2013.01)

(58) Field of Classification Search

CPC ..... B26B 21/4056; B26B 21/4087; B26B 21/521; B26B 21/526; B26B 21/225

See application file for complete search history.

(56) References Cited

U.S. PATENT DOCUMENTS

| | | | | |
|---|---|---|---|---|
| 10,131,063 | B2 * | 11/2018 | Metcalf | B26B 21/521 |
| 2004/0098862 | A1 | 5/2004 | Orloff | |
| 2017/0087733 | A1 * | 3/2017 | Metcalf | B26B 21/14 |
| 2017/0097758 | A1 | 4/2017 | Bauer et al. | |
| 2017/0305023 | A9 | 10/2017 | Ball et al. | |
| 2019/0224869 | A1 * | 7/2019 | Robinson | B26B 21/227 |
| 2019/0224870 | A1 | 7/2019 | Robinson et al. | |
| 2019/0224871 | A1 | 7/2019 | Amavasai et al. | |

(Continued)

OTHER PUBLICATIONS

All Office Actions, U.S. Appl. No. 16/920,304.

(Continued)

*Primary Examiner* — Omar Flores Sanchez
(74) *Attorney, Agent, or Firm* — Kevin C. Johnson

(57) ABSTRACT

A grooming device. The grooming device includes a handle having a housing portion with proximal and distal ends. A displacement sensor is positioned within the handle. A power source is positioned within the handle and provides power to the displacement sensor. A neck portion of the handle has proximal and distal ends and the distal end of the neck portion is connected to the proximal end of the housing portion. An implement connecting structure is positioned at the proximal end of the neck portion and includes a connection element. An eject element is moveable within the handle, and a location element is connected to the eject element. A grooming implement is connected to the connection element. As the eject element moves to eject the grooming implement from the connection element the displacement sensor detects displacement of the location element.

16 Claims, 6 Drawing Sheets

(56) References Cited

U.S. PATENT DOCUMENTS

| | | | | |
|---|---|---|---|---|
| 2020/0122348 | A1* | 4/2020 | Good | B26B 19/388 |
| 2020/0201266 | A1 | 6/2020 | Joyce et al. | |

OTHER PUBLICATIONS

All Office Actions, U.S. Appl. No. 16/920,311.
Unpublished U.S. Appl. No. 16/920,304, filed Jul. 2, 2020, to first inventor Alexander Hiller.
Unpublished U.S. Appl. No. 16/920,311, filed Jul. 2, 2020, to first inventor Ian Anthony Good.
PCT Search Report and Written Opinion for PCT/US2021/038340 dated Oct. 20, 2021, 13 pages.

* cited by examiner

GROOMING DEVICE WITH EJECT BUTTON DISPLACEMENT

FIELD OF THE INVENTION

The present invention relates to a grooming device and more particularly to a grooming device having the ability to improve the usage experience of the grooming device by providing information about the usage experience to the user related to the grooming device.

BACKGROUND OF THE INVENTION

There are numerous grooming devices used by consumers every day. Proper usage techniques of such grooming devices and product consumption information facilitate the overall efficacy of the product providing the user with a more positive experience than he or she would have otherwise experienced. Such positive usage experiences will likely lead to continued product usage. Providing the user with information about proper usage techniques for using grooming devices and information about usage and consumption has been limited.

Razors with sensors have been used to provide shave event information to the user. For example, razors with proximity sensors or cameras have been used to provide information on blade attrition and razors with force sensors have been used to provide the user with information on the amount of force being applied to the skin. By tracking the force being applied during the shave provides a metric to gauge blade dulling and predict blade attrition. Razors having sensors to count shaving strokes have also been used to again assist with blade attrition. Cameras have been used to provide users with boundary indicators such as distinguishing between areas of long hair such as sideburns adjacent to areas of shorter hair length.

Razor cartridge consumption is a main driver of value and accurate cartridge consumption data is of interest to grooming device manufacturers and consumers alike. In order to be able to accurately track cartridge usage, two data streams are required; shave event data and cartridge change data. If both of these data streams are available, it is possible both to track consumer usage behavior and provide consumer relevant features such as cartridge life indication. While grooming devices, such as razors, with sensors to provide shave event data have been provided, a grooming device that can provide cartridge change data is needed.

SUMMARY OF THE INVENTION

The present invention relates to a grooming device. The grooming device comprises a handle and a grooming element. The handle comprises a housing portion comprising a proximal end, a distal end, and a displacement sensor positioned within the handle. A power source is positioned within the handle and provides power to the displacement sensor. A neck portion of the handle comprises a proximal end and a distal end that is connected to the proximal end of the housing portion. An implement connecting structure of the handle is positioned at the proximal end of the neck portion and comprises a connection element. An eject element is moveable within the handle and a location element is connected to the eject element. The grooming implement is connected to the connection element. As the eject element moves to eject the grooming implement from the connection element the displacement sensor detects displacement of the location element.

The displacement sensor can be positioned within the housing portion. The displacement sensor can also be positioned within the neck portion.

The power source can be positioned within the housing portion of the handle.

The displacement sensor may comprise a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

The location element may comprise a magnet, a visual marker, a physical marker, or an electrically conductive material.

The handle may further comprise a communication device.

The communication device may comprise a visual indicator, an LED, a vibration mechanism, an audio mechanism, a wired connection, a Bluetooth connection, a Wi-Fi connection, a cellular connection, or an infrared connection.

Data from the displacement sensor can be communicated to a user or to another device.

The handle may further comprise a shave event sensor.

The handle may process cumulative shave data from the shave event sensor. Data from the displacement sensor is used to reset the cumulative shave data.

The grooming device may comprise an electric shaver, a shaving razor, and/or an epilator.

An algorithm can calculate an eject event of the grooming implement based on displacement of the location element.

The eject element may be slidably connected to the neck portion or to the implement connecting structure.

BRIEF DESCRIPTION OF THE DRAWINGS

While the specification concludes with claims particularly pointing out and distinctly claiming the subject matter that is regarded as forming the present invention, it is believed that the invention will be better understood from the following description, which is taken in conjunction with the accompanying drawings in which like designations are used to designate substantially identical elements, and in which:

DETAILED DESCRIPTION OF THE INVENTION

Figure 1:
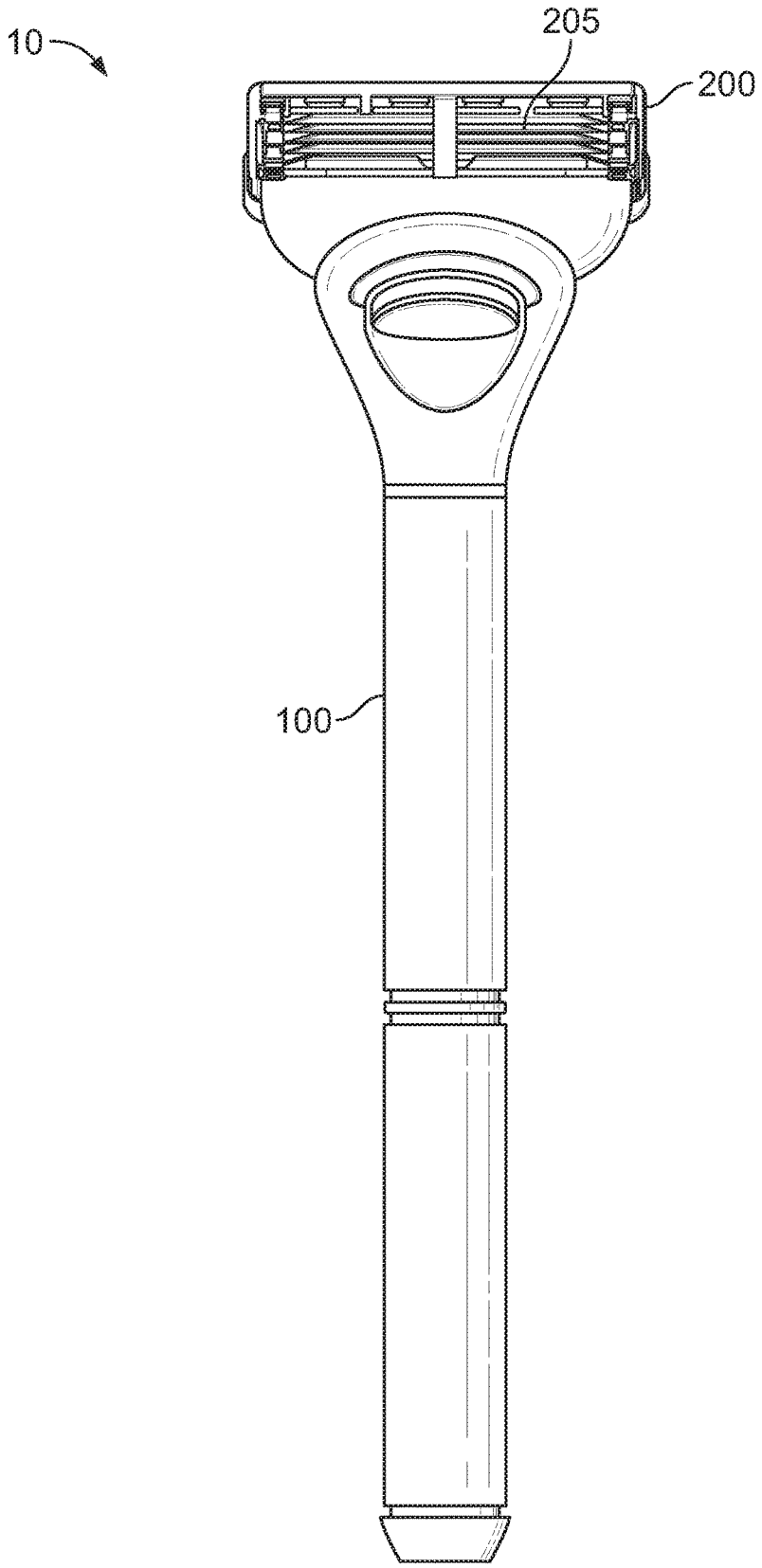
FIG. 1 is a front plan view of a grooming device of the present invention.
Figure 2:
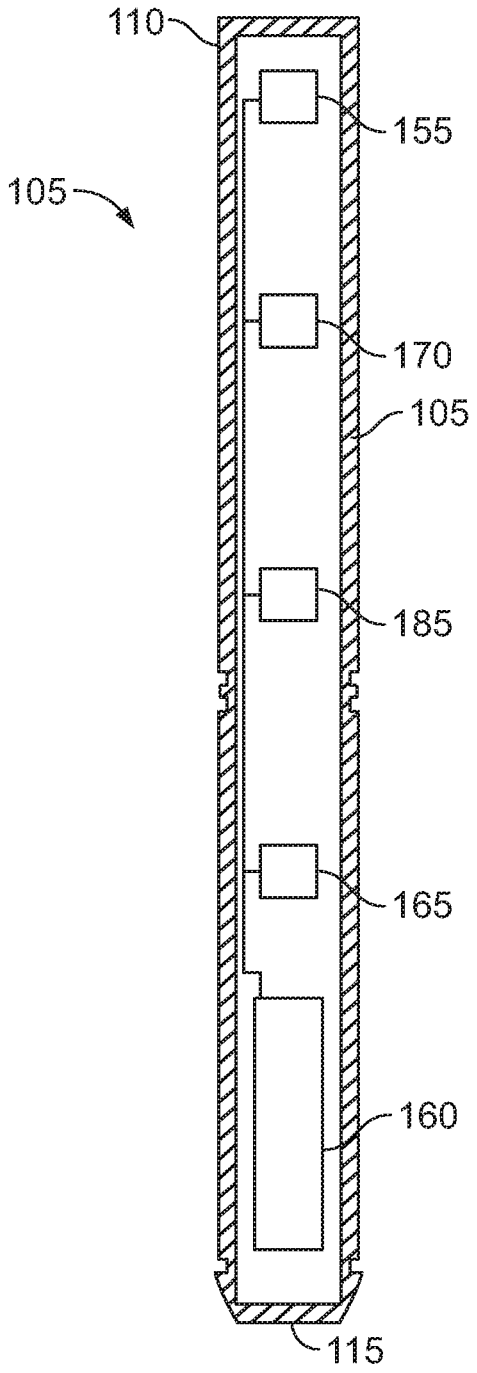
FIG. 2 is a cut away view of the housing portion of the handle of the grooming device of FIG. 1.

Referring to FIGS. 1-5, a grooming device 10 is shown. As shown, grooming device 10 is a shaving razor, but could also be an electric shaver, an epilator, and/or any other type of grooming device. Grooming device 10 generally includes a handle 100 and a grooming implement 200 removably connected to handle 100. The grooming implement 200 shown is a razor cartridge that includes one or more blades 205 for cutting hair.

Handle 100 has a housing portion 105, that is preferably water tight, and a neck portion 120 connected to housing portion 105. Housing portion 105 has a proximal end 110 and an opposing distal end 115, neck portion 120 has a proximal end 125 and an opposing distal end 130, and distal end 130 of neck portion 120 is connected to proximal end 110 of housing portion 105. An implement connecting structure 135 is positioned at proximal end 125 of neck portion 120 and has a connection element 140 configured to secure grooming implement 200 to handle 100. An eject element 145, such as a push button, is moveable, preferably slidable, within handle 100 and is configured to eject grooming implement 200 from handle 100. Eject element 145 can be moveably connected to either neck portion 120 or to implement connecting structure 135. A location element 150, which can be a magnet, a visual marker, an electronically conductive material, etc., is connected to eject element 145 and is preferably embedded or secured within eject element 145.

Figure 3A:
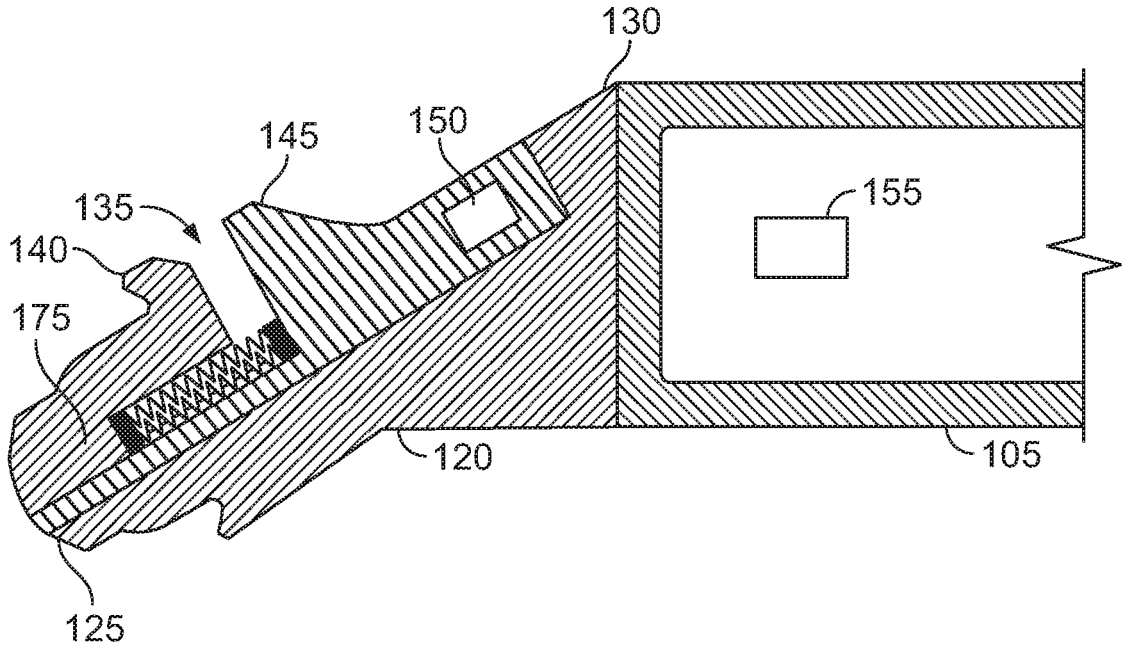
FIGS. 3A-B are partial cut away views of the grooming device of FIG. 1 with the eject element in different positions.
Figure 3B:
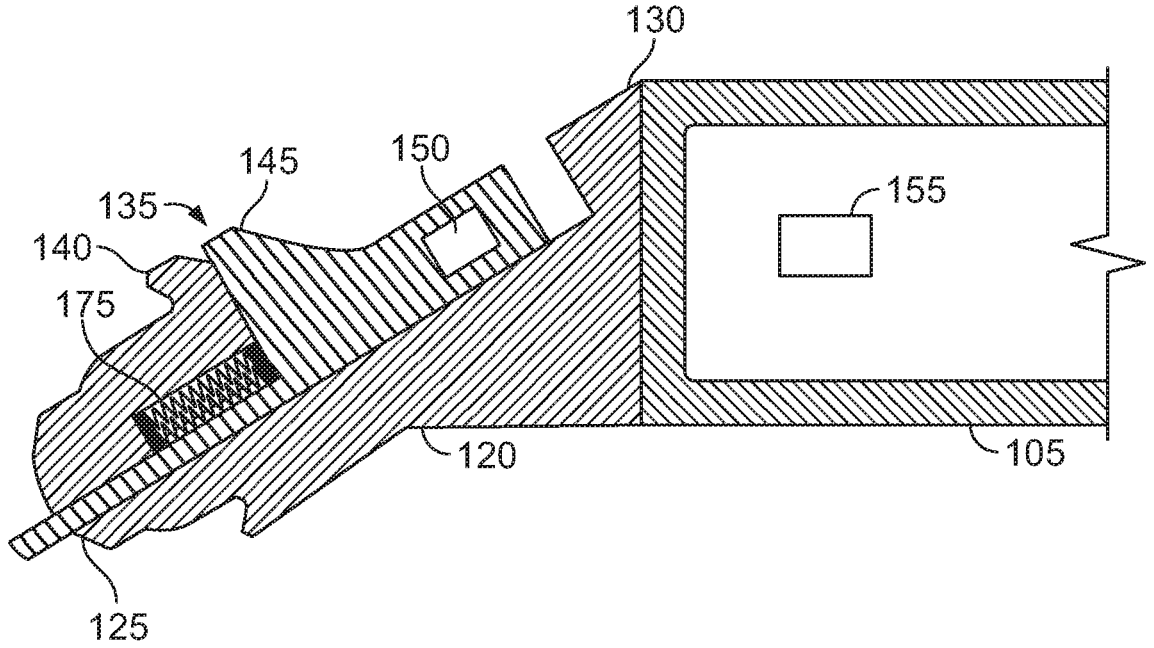
Figure 4:
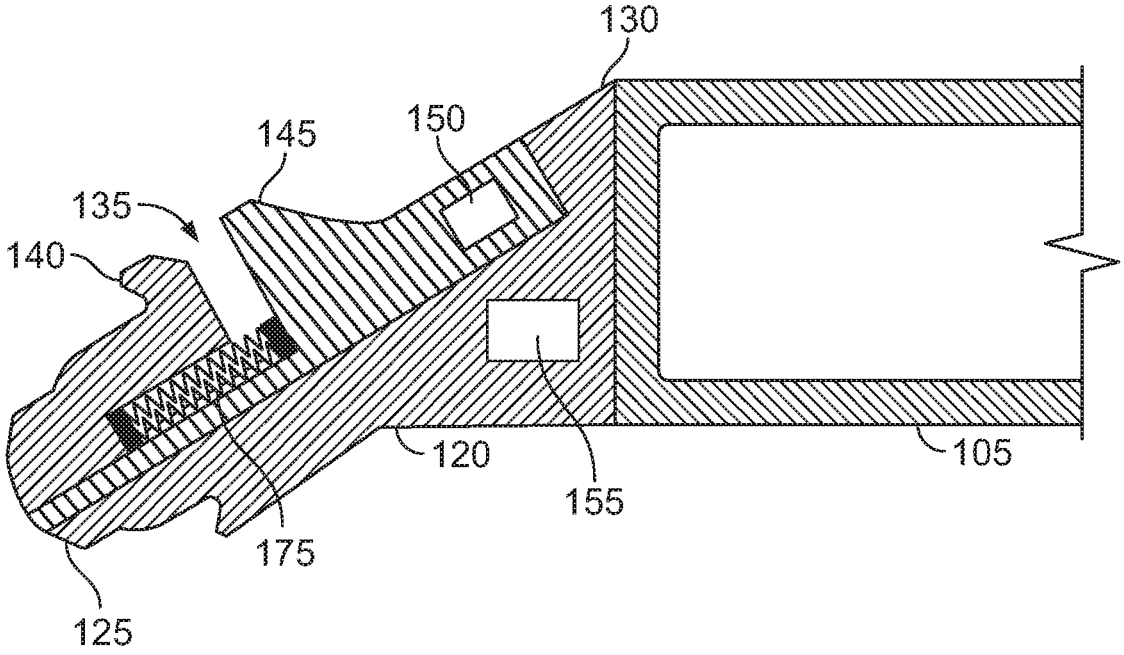
FIG. 4 is a partial cut away view of the grooming device of FIG. 1 with the displacement sensor in a different position.

A displacement sensor 155, which is preferably a contactless sensor and could be a magnetic sensor, an optical sensor, a capacitive sensor, an inductive sensor, a resistive sensor, a conductive sensor, a proximity sensor, an electrical switch, a mechanical switch, an electromechanical switch, an electromagnetic switch, etc., is positioned within handle 100 and is configured to sense the position of location element 150. As shown in FIGS. 3A-B, displacement sensor 155 can be positioned within housing portion 105 of handle 100, preferably at proximal end 110 of housing portion 105, immediately adjacent neck portion 120. One advantage of positioning displacement sensor 155 in housing portion 105 is that displacement sensor 155 is protected by watertight housing portion 105 and no additional electrical connections are required between housing portion 105 and neck portion 120. Alternatively, as shown in FIG. 4, displacement sensor 155 can also be positioned in neck portion 120 of handle 100, outside housing portion 105. One advantage to positioning displacement sensor 155 in neck portion 120 is that displacement sensor 155 and location element 150 are positioned closer together to allow displacement sensor 155 to more easily detect location element 150. A power source 160, such as a battery, is positioned within handle 100, preferably within housing portion 105 of handle 100, and is operatively connected to displacement sensor 155 to provide power to displacement sensor 155 and to any other sensors and devices within handle 100 that require power. If displacement sensor 155 is positioned in neck portion 120, an electrical connection would also be provided between housing portion 105 and neck portion 120 to operatively connect displacement sensor 155 and power source 160.

Grooming implement 200 is connected to the connection element 140 of implement connecting structure 135 of handle 100 and can be ejected from handle 100 through activation of eject element 145. Eject element 145 is biased into a first position by a spring 175, as shown in FIG. 3A, and location element 150 is positioned a first distance away from displacement sensor 155. To eject grooming implement 200, eject element 145 is moved from the first position to a second position, as shown in FIG. 3B, which pushes grooming implement 200 off of connection element 140. As eject element 145 moves from the first position to the second position to eject grooming implement 200 from connection element 140, location element 150 moves away from displacement sensor 155 and displacement sensor 155 can detect the change in position and displacement of location element 150. A processor 185 within housing portion 105 of handle 100 can use an algorithm to calculate and eject event of grooming implement 200 based on the displacement of location element 150 detected by displacement sensor 155.

Handle 100 can also include a shave event sensor 170, preferably in housing portion 105, such as those discussed in U.S. patent application Ser. No. 16/251,535, the entirety of which is incorporated by reference herein. Handle 100 can process cumulative shave data from shave event sensor 170, for example using processor 185, and data from displacement sensor 155 regarding the ejection of grooming implement 200 can be used to reset the cumulative shave data.

Handle 100 can also include a communication device 165, such as a visual indicator, a light emitting diode (LED), a vibration mechanism, an audio mechanism, a wired connection, a Bluetooth connection, a Wi-Fi connection, an infrared connection, a cellular connection, etc., which can be used to communicate data from displacement sensor 155 to a user of grooming device 10 and/or to another device, such as another grooming device 10, base 300, a mobile phone, a computer application, a computer, an electronic device, etc.

In use, grooming implement 200 is connected to connection element 140 and eject element 145 remains in the first position or rest position (FIG. 3A) via the force provided by spring 175. In the first position, displacement sensor 155 will detect a constant position of stationary location element 150. When eject element 145 is moved from the first position to the second position (FIG. 3B) to eject grooming implement 200, eject element 145 slides forward and the distance between displacement sensor 155 and location element 150 increases. The increase in the distance between displacement sensor 155 and location element 150 results in a reduction of the signal strength from location element 150 to displacement sensor 155. Once grooming implement 200 has been detached and any user force removed from eject element 145, spring 175 biases eject element 145 back to the first position, which again increases the signal strength from location element 150 to displacement sensor 155. The data from displacement sensor 155 can then be analyzed to identify an eject event, which is characterized by a momentary negative peak or reduction in the signal strength as location element 150 is moved away from displacement sensor 155 and back.

Figure 5:
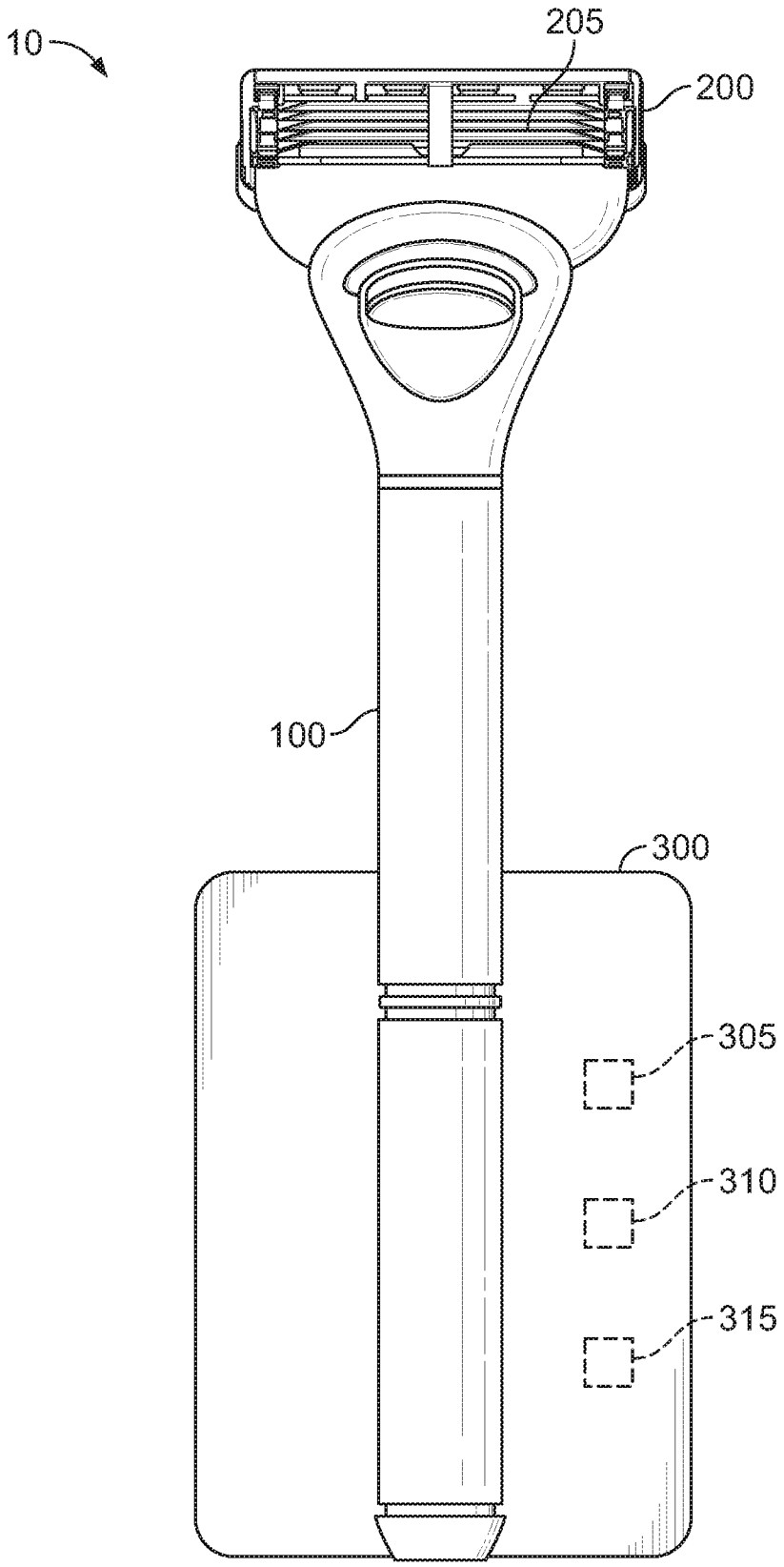
FIG. 5 is a front plan view of the grooming device of FIG. 1 and a base.
Figure 6:
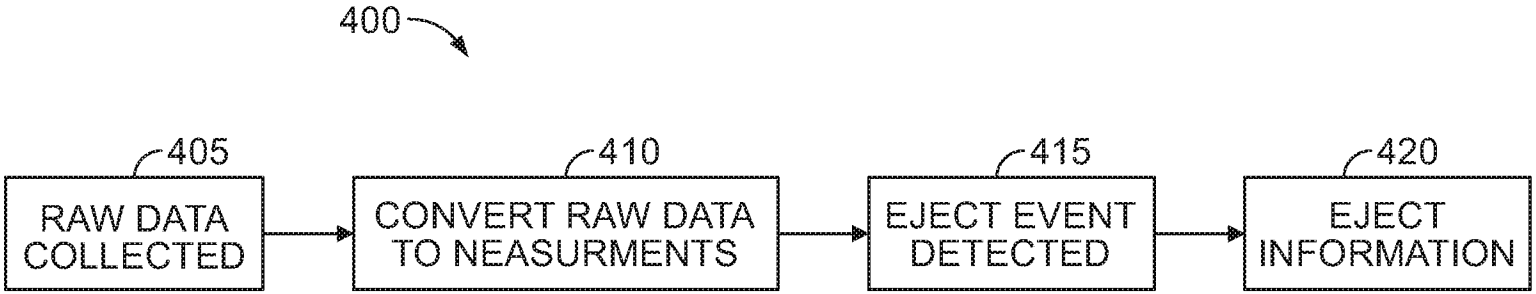
FIG. 6 is a plan diagram of the collected eject event data and associated algorithms.

As shown in FIG. 5, when not in use, grooming device 10 can be held in base 300, which can serve as a charging station for power source 160. Base 300 may also include a communication device 305, which can communicate with communication device 165 in handle 100 of grooming device 10 and/or can be mounted in base 300 so that it is visible to the user to provide direct communication to the user. Base 300 may also include a processor 310 and memory 315, which can store data received from grooming device 10 to be processed by processor 310.

Referring now to FIGS. 6 and 1-5 there is shown a plan diagram 400 of the collected data and algorithms used with grooming device 10. At 405, with the power source 160 on, raw data is collected from displacement sensor 155 and, if used, from shave event sensor 170. The raw data is then converted into measurements at 410. The measurements may be made by processor 185 in handle 100. Alternatively, the raw data can be sent from communication device 165 to an external device such as a mobile phone, a computer application, a computer, or other electronic device to convert the raw data in measurements.

At 415 an eject event including the ejection of grooming implement 200 from handle 100 is detected from the raw data of displacement sensor 155 using an algorithm. The algorithm may comprise monitoring the displacement of location element 150 by displacement sensor 155 to detect movement of eject element 145 and calculating an eject event of grooming implement 200 based on displacement of location element 150. The algorithm may comprise monitoring the activity strength as recorded by displacement sensor 155.

At 420 grooming implement eject information can be generated from the measurements based on the data from displacement sensor 155. In addition, if shave event sensor 170 is used and handle 100 processes cumulative shave data, data from displacement sensor 155 can be used to reset the cumulative shave data based on the grooming implement eject information and/or to trigger a notification to the user asking them to confirm or cancel the reset of the cumulative shave data based on the grooming implement eject information.

An Example is Below:

A. A grooming device comprising:

a. a handle comprising;

i. a housing portion comprising a proximal end and a distal end;

ii. a displacement sensor positioned within the handle;

iii. a power source positioned within the handle, the power source providing power to the displacement sensor;

iv. a neck portion comprising a proximal end and a distal end, the distal end of the neck portion being connected to the proximal end of the housing portion;

v. an implement connecting structure positioned at the proximal end of the neck portion and comprising a connection element; and vi. an eject element moveable within the handle, and a location element, the location element being connected to the eject element; and b. a grooming implement connected to the connection element, wherein as the eject element moves to eject the grooming implement from the connection element the displacement sensor detects displacement of the location element.

B. The grooming device of paragraph A, wherein the displacement sensor is positioned within the housing portion.

C. The grooming device of paragraph A, wherein the displacement sensor is positioned within the neck portion.

D. The grooming device of any one of paragraphs A-C, wherein the power source is positioned within the housing portion of the handle.

E. The grooming device of any one of paragraphs A-D, wherein the displacement sensor comprises a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

F. The grooming device of any one of paragraphs A-E, wherein the location element comprises a magnet, a visual marker, a physical marker, or an electrically conductive material.

G. The grooming device of any one of paragraphs A-F, wherein the handle contains a communication device.

H. The grooming device of paragraph G, wherein the communication device comprises a visual indicator, an LED, a vibration mechanism, an audio mechanism, a wired connection, a Bluetooth connection, a Wi-Fi connection, a cellular connection, or an infrared connection.

I. The grooming device of paragraph G, wherein data from the displacement sensor is communicated to a user or to another device.

J. The grooming device of any one of paragraphs A-I, wherein the handle further comprises a shave event sensor.

K. The grooming device of paragraph J, wherein the handle processes cumulative shave data from the shave event sensor.

L. The grooming device of paragraph K, wherein data from the displacement sensor is used to reset the cumulative shave data.

M. The grooming device of any one of claims A-L, wherein the grooming device comprises an electric shaver, a shaving razor, and/or an epilator.

N. The grooming device of any one of claims A-M, wherein an algorithm calculates an eject event of the grooming implement based on displacement of the location element.

O. The grooming device of any one of claims A-N, wherein the eject element is moveably connected to the neck portion.

P. The grooming device of any one of claims A-O, wherein the eject element is moveably connected to the implement connecting structure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A grooming device comprising:

a. a handle comprising;

i. a housing portion comprising a proximal end and a distal end;

ii. a displacement sensor positioned within the handle;

iii. a power source positioned within the handle, the power source providing power to the displacement sensor;

iv. a neck portion comprising a proximal end and a distal end, the distal end of the neck portion being connected to the proximal end of the housing portion; and v. an implement connecting structure positioned at the proximal end of the neck portion and comprising a connection element;

vi. an eject element moveable within the handle, and a location element, the location element being connected to the eject element; and b. a grooming implement connected to the connection element, wherein as the eject element moves to eject the grooming implement from the connection element the displacement sensor detects displacement of the location element.

2. The grooming device of claim 1, wherein the displacement sensor is positioned within the housing portion.

3. The grooming device of claim 1, wherein the displacement sensor is positioned within the neck portion.

4. The grooming device of claim 1, wherein the power source is positioned within the housing portion of the handle.

5. The grooming device of claim 1, wherein the displacement sensor comprises a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

6. The grooming device of claim 1, wherein the location element comprises a magnet, a visual marker, a physical marker, or an electrically conductive material.

7. The grooming device of claim 1, wherein the handle contains a communication device.

8. The grooming device of claim 7, wherein the communication device comprises a visual indicator, an LED, a vibration mechanism, an audio mechanism, a wired connection, a Bluetooth connection, a Wi-Fi connection, a cellular connection, or an infrared connection.

9. The grooming device of claim 7, wherein data from the displacement sensor is communicated to a user or to another device.

10. The grooming device of claim 1, wherein the handle further comprises a shave event sensor.

11. The grooming device of claim 10, wherein the handle processes cumulative shave data from the shave event sensor.

12. The grooming device of claim 11, wherein data from the displacement sensor is used to reset the cumulative shave data.

13. The grooming device of claim 1, wherein an algorithm calculates an eject event of the grooming implement based on displacement of the location element.

14. The grooming device of claim 1, wherein the grooming device comprises an electric shaver, a shaving razor, and/or an epilator.

15. The grooming device of claim 1, wherein the eject element is moveably connected to the neck portion.

16. The grooming device of claim 1, wherein the eject element is moveably connected to the implement connecting structure.

* * * * *